US007347140B2

(12) United States Patent
Scheucher et al.

(10) Patent No.: US 7,347,140 B2
(45) Date of Patent: Mar. 25, 2008

(54) SCREW PRESS FOR SEPARATION OF LIQUID FROM SOLID-LIQUID MIXTURES ESPECIALLY PULP SUSPENSIONS

(75) Inventors: Peter Scheucher, Kumberg (AT); Rudolf Stadlauer, Eggersdorf (AT); Dietmar Hausjell, Graz (AT); Rupert Brunnsteiner, Graz (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 11/040,367

(22) Filed: Jan. 21, 2005

(65) Prior Publication Data

US 2006/0174781 A1 Aug. 10, 2006

(51) Int. Cl.
*B30B 9/14* (2006.01)
*B30B 9/18* (2006.01)

(52) U.S. Cl. ..... 100/117; 100/127; 100/148

(58) Field of Classification Search ..... 100/104, 100/110, 111, 117, 126, 127, 145, 146, 147, 100/148, 149, 150; 210/396, 403, 414, 415
See application file for complete search history.

(56) References Cited

U.S. PATENT DOCUMENTS 1,835,789 A * 12/1931 Lang ..... 100/117
2,930,314 A * 3/1960 Carlson ..... 100/147
4,915,830 A * 4/1990 Mackay et al. ..... 210/209
5,515,776 A * 5/1996 Scheucher et al. ..... 100/112
6,550,376 B2 * 4/2003 Johnston ..... 100/146

* cited by examiner

*Primary Examiner*—Jimmy T. Nguyen
(74) *Attorney, Agent, or Firm*—Alix, Yale & Ristas, LLP

(57) ABSTRACT

Screw press for separation of liquid from solid liquid mixtures, especially pulp suspensions, with a casing with perforations for liquid and a screw shaft provided in it between which a circular gap is formed through which the solid liquid mixture is pressed. Furthermore, a counter pressure device in the area of the discharge end of the circular gap is provided. To reduce the space requirement in the discharge area at the discharge end of the circular gap, which makes it possible to reduce the size of the discharge casing and cut costs due to a less complicated design, the counter pressure device has a counter pressure surface, the radius of which is decreasing in the conveying direction of the solid liquid mixture. In this way the solid liquid mixture with the liquid largely extracted will be redirected radially inwards and outside of the counter pressure device no additional space is needed to discharge the solid liquid mixture with the liquid largely extracted, so that the discharge casing may be reduced in size correspondingly.

12 Claims, 4 Drawing Sheets

SCREW PRESS FOR SEPARATION OF LIQUID FROM SOLID-LIQUID MIXTURES ESPECIALLY PULP SUSPENSIONS

BACKGROUND OF THE INVENTION

The invention relates to a screw press for separation of liquid from solid liquid mixtures, especially pulp suspensions, with a casing with perforations for liquid and a screw shaft provided in it between which a circular gap is formed through which the solid liquid mixture is pressed and with a counter pressure device in the area of the discharge end of the circular gap.

The counter pressure device is used to create at the end of the circular gap a backup of the solid liquid mixture with the liquid largely extracted so as to further increase the pressure in the circular gap to extract even more liquid from the solid liquid mixture. In the area of the counter pressure device or subsequent to it the solid liquid mixture with the liquid largely extracted has to be redirected so it can be discharged.

In the state of the art, e.g. AT 398 090 B the redirection is achieved radially outwards whereby the casing surrounding the discharge area is relatively large, however essentially larger than the casing of the screw, as it is necessary to not only have space for the counter pressure device, but also for the solid liquid mixture with the liquid largely extracted. This is not only a disadvantage due to the increased space requirement but also in view of the design, as the relatively large discharge casing has a worse stiffness which has to be compensated by a reinforced construction.

SUMMARY OF THE INVENTION

The invention thus has the objective to provide a screw press where the space requirement in the discharge area is decreased and further also the discharge casing may be reduced in size and designed technically less complicated.

Due to the fact that the counter pressure device has a counter pressure surface with a radius decreasing viewed in conveying direction of the solid liquid mixture, the solid liquid mixture with the liquid largely extracted is redirected radially inwards. With this design, radially outside the counter pressure device there is no need for additional space for the discharge of the solid liquid mixture with the liquid largely extracted leading to a consequently reduced size of the discharge casing.

In a preferred embodiment the screw shaft has a drum and at least one helical blade and the drum at the discharge end of the circular gap has a discharge area for the solid liquid mixture with the liquid at least partly extracted, whose diameter decreases in conveying direction in the vicinity of the counter pressure device.

In this way radially inside the counter pressing device an additional space is created for the discharge of the solid liquid mixture with the liquid largely extracted.

With this invention also the already mentioned problem of stiffness can be improved. With a large discharge casing there are high axial displacements between the screw shaft and the casing with perforations (high pressure screen basket) or discharge casing during transmission of the axial forces due to bending of the vertical walls of the discharge casing which thus has to be built very stiff. Therefore the axial bearing is often installed at the feed side so that the path of the force will be long but linear and no bending of the vertical walls will occur. This however has the disadvantage that the point of reference is on the feed side and in large presses the highly loaded discharge casing has to be fixed with gliding stones due to the thermal expansion (up to 10 mm). When using high pressure screen baskets in most cases the legs will bend.

According to a preferred embodiment of the invention the solution to this problem may be in that the axial bearing of the screw shaft is arranged at the discharge end of the screw shaft and connects the casing via a discharge casing with a diameter essentially equal to the diameter of the casing surrounding the discharge area for transmission of the axial forces.

With this embodiment of the invention the discharge casing may be a tube which is not much larger than the casing or high pressure screen basket. In this way the path of the force to the axial bearing at the discharge end is linear and short (without bending elements) and the low loaded feed side may expand freely.

BRIEF DESCRIPTION OF THE DRAWINGS

The present invention may be better understood and its numerous objects and advantages will become apparent to those skilled in the art by reference to the accompanying drawings in which.

BRIEF DESCRIPTION OF THE PREFERRED EMBODIMENT

Figure 1:
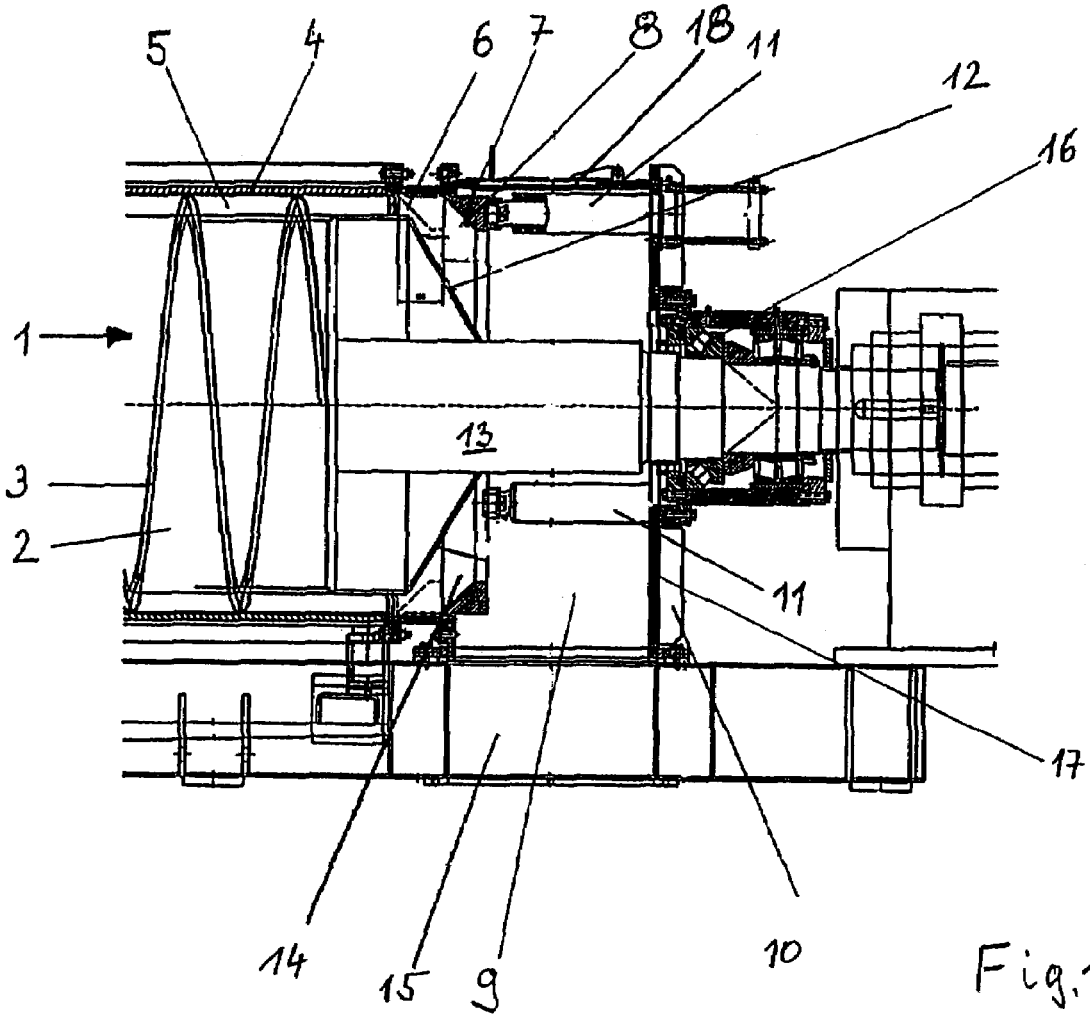
FIG. 1 is a simplified side view, partly in phantom, of a first embodiment of a screw press in accordance with the invention.
Figure 2:
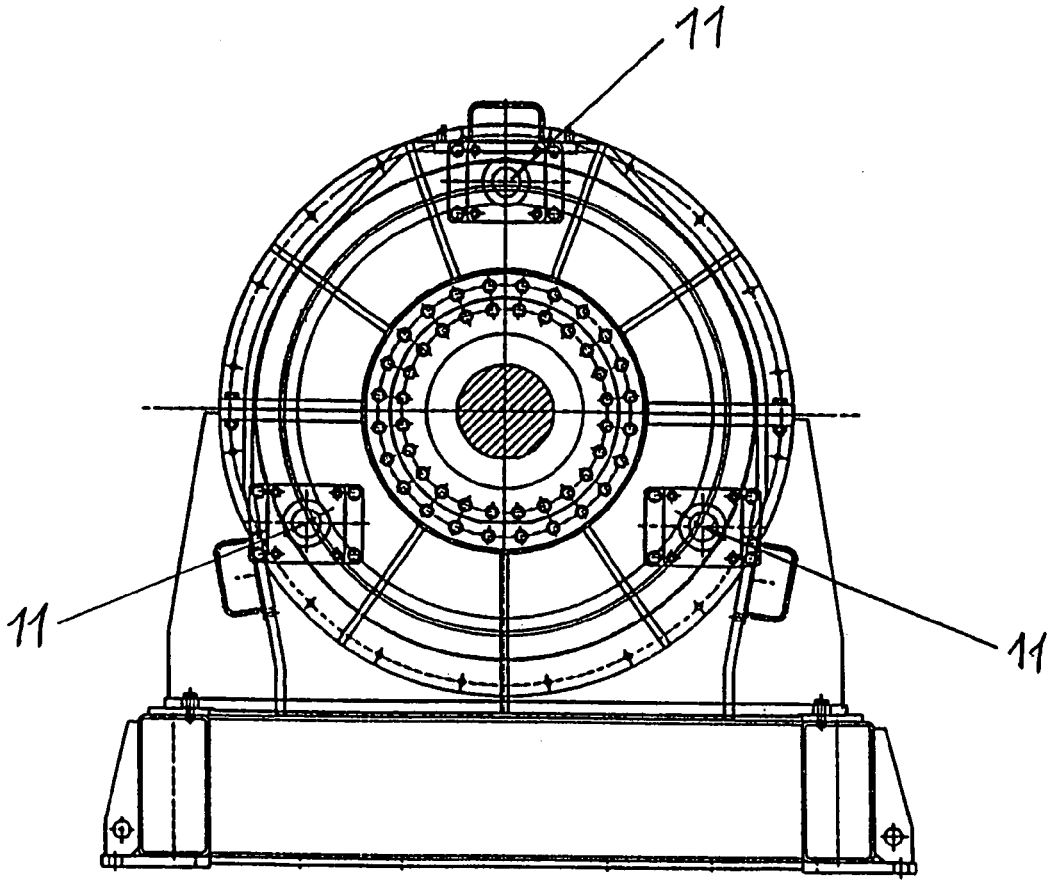
FIG. 2 is a front view of the screw press of FIG. 1.

In FIGS. 1 and 2 the discharge end of a first embodiment of the invention is shown. The feed side not shown may be designed according to the state of the art, for example as shown in AT 398 090 B.

The screw press according to the invention has, insofar as is essential for the understanding of the invention in hand, a screw shaft 1 with a drum 2 and a single or multi channel helical blade 3 which is supported rotatable in a screen like casing 4 with perforations so liquids can pass. Between the drum 2 and the casing 4 a circular gap 5 is formed, through which a solid liquid mixture, especially a pulp suspension, is conveyed, from which the liquid is to be extracted. The conveying direction of the pulp suspension in FIG. 1 is from left to right.

At the discharge end 6 of the circular gap 5 a counter pressure device 7 is provided, which is shown in the example as a ring with a total cross section. On the side facing the circular gap 5 the counter pressure device 7 has a counter pressure surface 8 which essentially narrows conically in the conveying direction. Deviations from the exact conical form are possible, for example due to consecutive portions with different conical angles or conical angles changing continuously or discontinuously. Deviations in axial direction or circumferential direction of the counter pressure surface of a "smooth" wall are also possible.

The counter pressure device 7 is arranged in a discharge casing where on its frame 10 three hydraulic cylinders 11 are mounted, by which also the counter pressure device 7 is supported. With the hydraulic cylinders 11 the counter pressure device 7 may be displaced in axial direction of the screw shaft 1. The pressure of the cylinders 11 may be controlled by the throughput or torque whereby the gap at the end of the plug is self adjusting by the pulp amount discharged.

At the end 6 of the circular gap 5 the essentially cylindrical drum 2 of the screw shaft 1 turns into a discharge area 12 in form of a truncated cone which also tapers in conveying direction. Thus between the counter pressure surface 8 of the counter pressure device 7 and the truncated cone 12 of the screw shaft 1 a decreasing gap 14 in radial direction is formed whose cross section area however is increasing in conveying direction.

To extract the liquid from the pulp suspension it is fed in through a feed connection not shown in the drawings and then by continuous turning of the screw shaft it is pressed through the gradually decreasing circular gap 5 in the direction of the counter pressure surface 8 of the counter pressure device 7. In this way the liquid contained in the pulp suspension is continuously extracted and exits through the perforations in the casing 4. At the discharge end 6 of the circular gap 5 the essentially dewatered pulp suspension is diverted at the counter pressure surface 8 and is guided radially inwards in the gap 14. Subsequently, the pulp suspension is discharged through a chute 15.

The shaft end 13 is, as may be seen in FIG. 1, supported by a spherical roller bearing 16 at the frame 10 of the discharge casing 9, with the front wall 17 of the discharge casing 9 being connected via an essentially tube-like wall 18 of the discharge casing 9 to the casing 4. As in this invention the pulp is diverted inwards at the end of the circular gap 5, the wall 18 of the discharge casing 9 may have essentially the same diameter as the casing 9, but in any case a smaller diameter than with the redirection of the pulp outwards according to the state of the art, being of advantageous from design view. In the same way the front wall 17 or the frame 10 of the discharge casing 9 may be designed smaller and more compact to decrease the load and mechanical deformations due to the force input from the screw shaft 1 via the bearing 16 to the discharge casing 9 and further to the casing 4.

Figure 3:
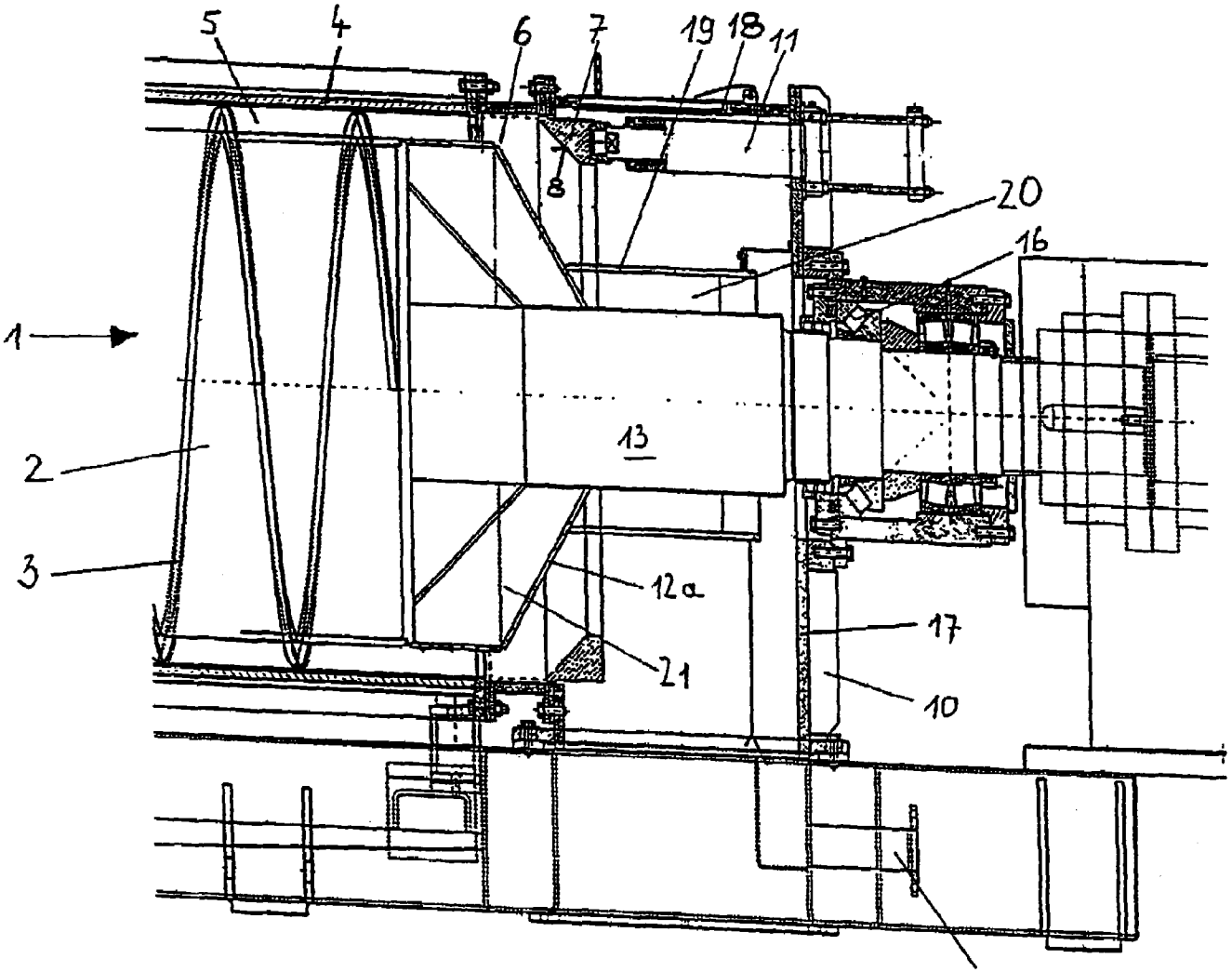
FIG. 3 is a simplified side view, partly in phantom, of a second embodiment of a screw press in accordance with the invention.

In FIG. 3 a very similar embodiment of the invention to FIG. 1 is shown, where however the wall of the truncated cone 12*a* is perforated in the discharge area so that additional extracted liquid may be drained off. To drain off the extracted liquid a tube 19 is provided adjacent to the truncated cone 12*a*, whose interior space 20 is in open connection to the interior space 21 of the truncated cone 12*a*. The liquid may further be drained off at the side facing away from the truncated cone 12*a* through a pipe 22.

Figure 4:
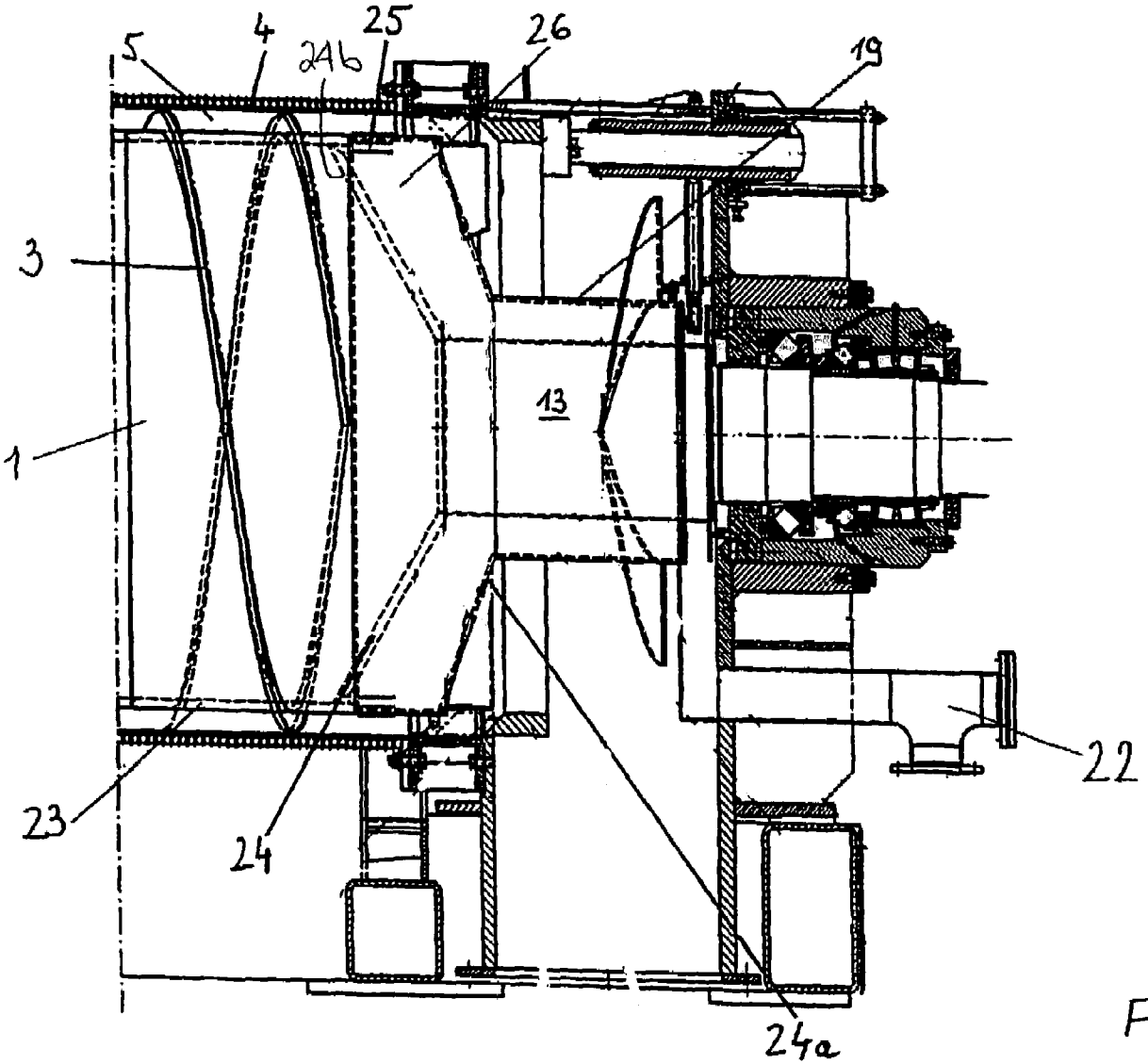
FIG. 4 is a simplified side view, partly in phantom, of a third embodiment of a screw press in accordance with the invention.

FIG. 4 shows a further embodiment of the invention where between the outer circumference 23 of the drum and the shaft end 13 two preferably conical circular ribs 24 are welded. Between the conical ring surface 24*b* arranged upstream of the shaft screen 25 and the conical ring surface 24*a*, which also may be designed as a circular ring, situated downstream of the shaft screen 25, and connected to the tube 19, radial ribs 26 are welded tightly so that cells 27 are formed which elevate the entering filtrate, from where it can get between tube 19 shaft end 13 to the discharge tube 22. Thus additional dewatering and controlled discharge of the fluid may be achieved. Downstream of the shaft screen 25 in turning direction after the end of the blade 3 (or with multi blade screws at the end of each blade) a bolt 28 is welded which loosens the pulp plug. The filter cake thus can be discharged in small pieces which also reduces the risk of clogging. On the last cone surface 24*a* there are ribs 29 welded at a certain angle axially and radially to direct the loosened pulp inwards and to the discharge opening. The pulp drops into the discharge chute 15 after the circular gap.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A screw press, for separation of liquid from solid-liquid mixtures, comprising:

a perforated casing having a plurality of perforations;

a screw shaft disposed within the perforated casing, the screw shaft defining an axis, the screw shaft extending axially to a shaft end and including a drum having an outer circumference and at least one helical blade mounted on the drum, the drum outer circumference and the perforated casing defining a gap adapted for receiving the solid-liquid mixture, the gap having a substantially circular cross section and extending axially in a conveying direction of the solid-liquid mixture to a discharge end, the drum also having a discharge area proximate to the discharge end of the gap, the discharge area having a tapering diameter;

a ring-shaped counter pressure device disposed proximate to the discharge end of the gap, the counter pressure device including a counter pressure surface having a radius that decreases in the conveying direction of the solid-liquid mixture;

a plurality of pressure cylinders, the pressure cylinders applying a force substantially uniformly over a circumference of the counter pressure device for displacing the counter pressure device in the axial direction of the screw shaft; and inner and outer circular ring surfaces disposed between the outer circumference of the drum and the shaft end.

2. The screw press of claim 1 wherein the pressure cylinder is a hydraulic cylinder.

3. The screw press of claim 1 wherein the pressure cylinder is a pneumatic cylinder.

4. The screw press of claim 1 wherein the counter pressure surface substantially tapers conically.

5. The screw press of claim 1 wherein the diameter of the discharge area proximate to the counter pressure device substantially tapers.

6. The screw press of claim 1 wherein the counter pressure surface decreases to an area of smallest diameter, the smallest diameter of the counter pressure surface being smaller than an outer diameter of the drum at the discharge end of the gap.

7. The screw press of claim 1 wherein the counter pressure device has a closed counter pressure surface.

8. The screw press of claim 1 wherein the drum has an end area including a shaft screen for the passage of liquid.

9. The screw press of claim 1 wherein the screw press further comprises a tube disposed around the shaft end the tube being in fluid communication with a discharge tube.

10. The screw press of claim 1 further comprising:

a discharge casing surrounding a discharge area and having essentially the same diameter as the perforated casing; and an axial bearing disposed at the discharge end of the screw shaft and connecting the perforated casing with the screw shaft by the discharge casing, for transmitting axial forces from the screw shaft.

11. The screw press of claim 1 wherein the outer circular ring surface includes ribs and the inner circular ring surface includes ribs.

12. The screw press of claim 1 wherein the circular ring surfaces each have a conical shape.

* * * * *